US011458373B2

(12) United States Patent
Wang et al.

(10) Patent No.: US 11,458,373 B2
(45) Date of Patent: Oct. 4, 2022

(54) GOLF CLUB HEADS WITH INTERNAL UNDERCUTS

(71) Applicant: KARSTEN MANUFACTURING CORPORATION, Phoenix, AZ (US)

(72) Inventors: Calvin S. Wang, Chandler, AZ (US); Alex G. Woodward, Phoenix, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/237,010

(22) Filed: Apr. 21, 2021

(65) Prior Publication Data

US 2021/0322839 A1 Oct. 21, 2021

Related U.S. Application Data

(60) Provisional application No. 63/013,341, filed on Apr. 21, 2020.

(51) Int. Cl.
*A63B 53/04* (2015.01)

(52) U.S. Cl.
CPC ..... *A63B 53/0475* (2013.01); *A63B 53/0412* (2020.08); *A63B 53/0433* (2020.08); *A63B 2053/0479* (2013.01)

(58) Field of Classification Search
CPC ..... A63B 53/0475
USPC ..... 473/324–350
See application file for complete search history.

(56) References Cited

U.S. PATENT DOCUMENTS

| | | | | |
|---|---|---|---|---|
| 6,849,005 | B2 | 2/2005 | Duong | |
| 7,025,694 | B2 | 4/2006 | Huang | |
| 7,083,531 | B2 | 8/2006 | Aguinaldo | |
| 7,247,811 | B2 | 7/2007 | Chen | |
| 7,731,604 | B2 | 6/2010 | Wahl | |
| 3,012,040 | A1 | 9/2011 | Takechi | |
| 8,439,770 | B1 | 5/2013 | Holt | |
| 8,932,150 | B2 | 1/2015 | Ines | |
| 9,211,451 | B1 * | 12/2015 | Westrum | A63B 60/42 |
| 9,522,311 | B2 | 12/2016 | Doi | |
| 9,586,105 | B1 | 3/2017 | Westrum | |
| 9,623,298 | B2 | 4/2017 | Ban | |
| 9,764,208 | B1 * | 9/2017 | Parsons | A63B 53/0475 |
| 10,039,965 | B1 * | 8/2018 | Seluga | A63B 60/54 |

(Continued)

FOREIGN PATENT DOCUMENTS

| | | | | |
|---|---|---|---|---|
| WO | WO-2016065157 A1 * | 4/2016 | | A63B 53/04 |
| WO | WO-2016133827 A2 * | 8/2016 | | A63B 53/04 |

OTHER PUBLICATIONS

"Pxg Launch 0211 Irons to the Mass Market" (https://woridwide.golf/equipment/pxg_0211_irons/).

(Continued)

*Primary Examiner* — Alvin A Hunter

(57) ABSTRACT

Described herein is a hollow body iron-type golf club head having a sole and ballast configured to relieve stress within a forward portion of the sole. In a first configuration, the golf club head comprises a ballast undercut for relieving stress. In other configurations, the ballast undercut is combined with additional stress relief features, such as a cascading sole near the face sole juncture, for further reductions to face thickness.

20 Claims, 14 Drawing Sheets

(56) References Cited

U.S. PATENT DOCUMENTS

| | | | | |
|---|---|---|---|---|
| 10,166,444 | B1 | 1/2019 | Forshner | |
| 10,173,109 | B1 * | 1/2019 | Seluga | A63B 53/0475 |
| 10,413,789 | B1 * | 9/2019 | Seluga | A63B 60/00 |
| RE47,653 | E | 10/2019 | Wahl | |
| 10,596,425 | B2 | 3/2020 | Parsons | |
| 10,792,543 | B2 | 10/2020 | Taylor | |
| 10,821,338 | B2 | 11/2020 | Hebreo | |
| 10,870,042 | B2 | 12/2020 | Wahl | |
| 10,881,925 | B2 | 1/2021 | Demkowski | |
| 2009/0023513 | A1 | 1/2009 | Shibata | |
| 2013/0331201 | A1 * | 12/2013 | Wahl | A63B 60/00 473/329 |
| 2014/0274442 | A1 * | 9/2014 | Honea | A63B 53/047 473/291 |
| 2014/0364248 | A1 * | 12/2014 | Wahl | A63B 60/00 473/345 |
| 2016/0045792 | A1 * | 2/2016 | Ines | A63B 60/00 473/349 |
| 2016/0158607 | A1 * | 6/2016 | Parsons | A63B 53/0466 473/350 |
| 2016/0332044 | A1 * | 11/2016 | Daraskavich | A63B 53/0475 |
| 2016/0339309 | A1 * | 11/2016 | Taylor | A63B 53/047 |
| 2017/0246517 | A1 | 8/2017 | Ueda | |
| 2017/0252613 | A1 * | 9/2017 | Daraskavich | A63B 53/0475 |
| 2017/0282027 | A1 * | 10/2017 | Parsons | B29C 45/14311 |
| 2017/0340928 | A1 * | 11/2017 | Parsons | A63B 53/0475 |
| 2018/0008872 | A1 * | 1/2018 | Parsons | A63B 53/047 |
| 2018/0111028 | A1 * | 4/2018 | Gonzalez | A63B 53/0475 |
| 2018/0185715 | A1 * | 7/2018 | Demkowski | A63B 53/0466 |
| 2018/0185717 | A1 * | 7/2018 | Demkowski | A63B 60/00 |
| 2018/0236325 | A1 * | 8/2018 | Parsons | A63B 53/0466 |
| 2018/0272199 | A1 * | 9/2018 | Taylor | A63B 60/00 |
| 2019/0240549 | A1 * | 8/2019 | Parsons | A63B 53/047 |
| 2020/0114221 | A1 | 4/2020 | Morales | |
| 2020/0171362 | A1 * | 6/2020 | Wang | A63B 60/54 |
| 2020/0188740 | A1 * | 6/2020 | Demkowski | A63B 53/047 |
| 2020/0276481 | A1 | 9/2020 | Higdon | |
| 2020/0346076 | A1 | 11/2020 | Henrikson | |
| 2020/0353325 | A1 * | 11/2020 | Taylor | A63B 53/042 |
| 2021/0046363 | A1 * | 2/2021 | Golden | A63B 53/047 |
| 2021/0322839 | A1 * | 10/2021 | Wang | A63B 53/0475 |
| 2021/0331045 | A1 * | 10/2021 | Halberg | A63B 53/0433 |

OTHER PUBLICATIONS

"Callaway's Epic Forged Irons Offer More Ball Speed and a Softer Feel", David Dusek (Year: 2019) (https://golfweek.usatoday.com/2019/07/16/callaway-epic-forged-irons/).

International Search Report and Written Opinion for PCT Application No. PCT/US2021/028502, 9 pages, dated Oct. 9, 2021.

* cited by examiner

GOLF CLUB HEADS WITH INTERNAL UNDERCUTS

RELATED APPLICATIONS

This claims the benefit to U.S. Provisional Patent Application No. 63/013,341, filed on Apr. 21, 2020, all of which is incorporated herein by reference.

FIELD

The present disclosure relates generally to golf equipment, and more particularly, to flexure structures for improved performance characteristics of hollow body irons and methods to manufacture hollow body irons with flexure structures.

BACKGROUND

Hollow body irons, ideally, operate as a diving board, flexing rearward during impact. In club design, the degree to which a hollow body iron behaves as a diving board, or spring is constrained by peak stress values. To ensure that traditional golf clubs do not exceed maximum stress limits, the face and sole are thickened such that the club is made more rigid. The rigidity of the traditional golf clubs results in a degradation to the diving board, or spring behavior of the club head. Therefore, there is a need in the art to produce a golf club head having a construction which expands the limit of modifications to the face to improve energy transfer from the club to the ball at impact.

Figure 1:
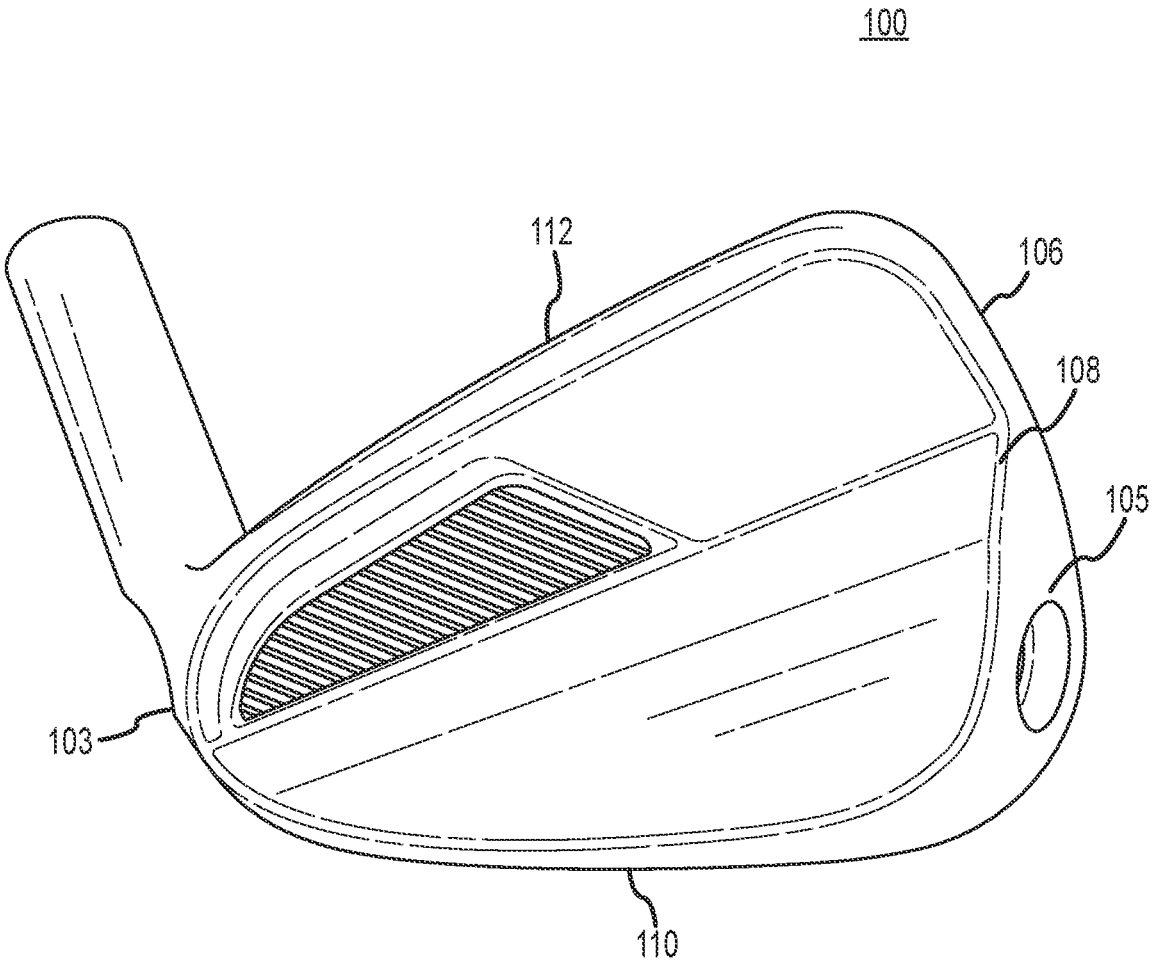
FIG. 1 depicts a toe end perspective view of a hollow body club head according to one embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The terms "loft" or "loft angle" of a hollow body golf club (hereafter "hollow body" or "hollow body iron" or "iron-type golf club head" or "golf club head"), as described herein, refers to the angle formed between the club face and the shaft, as measured by any suitable loft and lie machine. A loft plane lies tangent to the strikeface at the geometric center. A loft angle is measured between the ground plane and the loft plane. In many embodiments, the loft angle of the club head is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees, less than approximately 18 degrees, 17, or less than approximately 16 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, or greater than approximately 38 degrees.

DESCRIPTION

The present disclosure describes technologies for an improved hollow body iron-type golf club head (hererafter "hollow body" or "hollow body iron" or "iron-type golf club head" or "golf club head") having a sole and ballast configured to relieve stress within a forward portion of the sole. In a first configuration, the golf club head comprises a ballast undercut for relieving stress. In other configurations, the ballast undercut is combined with additional stress relief features, such as a cascading sole near the face sole juncture, for further reductions to face thickness.

The hollow body can comprise a strikeface, a rear portion, opposite the strikeface, a heel portion, a toe portion, opposite the heel, a sole, and a top rail to define an interior cavity. The rear portion can further include a ballast extending forward from the rear portion and into the interior cavity. In many embodiments, the ballast is an internal component such that it is not visible from the exterior of the golf club. The ballast can further comprise a geometry configured to increase the interior surface area of the sole. For example, the ballast can comprise a top surface, a forward surface, and a bottom surface defined as an undercut region. When viewed from a toe side cross section, an undercut is formed by the bottom surface's concave geometry relative to the face. The undercut allows the thinner, forward portion of the sole to extend beneath the ballast. A ballast comprising a bottom undercut surface, as opposed to a front surface that meets the interior surface of the sole at a right angle, (1) prevents stress from concentrating along the sole between the face and the ballast and (2) increases the portion of the sole capable of storing strain energy. Hollow body irons comprising an undercut, therefore, comprise sole and face geometries with greater range of thinning, as compared to hollow irons without an undercut.

The sole of the hollow body iron can be divided into two regions, the forward portion and the rear portion. The forward portion defines the thin region of the sole adjacent the strikeface, which can store strain energy. The rear portion of the sole describes the region of the sole adjacent to the to the rear portion of the of the body, which does not store strain energy. In other words, the forward portion of the sole 132 is the portion of the sole 110 that behaves as a spring. Hollow body irons having a thinner face and extended forward sole portion, as a result of the ballast undercut, store more strain energy (i.e., potential energy) than the face and forward sole portion of a club without an undercut. Consequently, the undercut improves the spring-like energy transfer between the club body and the golf ball (as compared to a golf club without and undercut). This energy transfer can be further improved in hollow body irons when the forward sole portion also comprises a cascade, in addition to the undercut. The cascading sole improves the flow of stress within the forward portion of the sole near the face sole juncture, while the undercut improves the flow of stress near the ballast. Accordingly, the application of the undercut and/or the combined application of the undercut and cascading sole can result in a golf club head, which can tolerate a 3-8% thinner face. Thus, the thinner face, which had been previously unattainable, results in an improved flight trajectory and distance.

I. Undercut

Figure 2A:
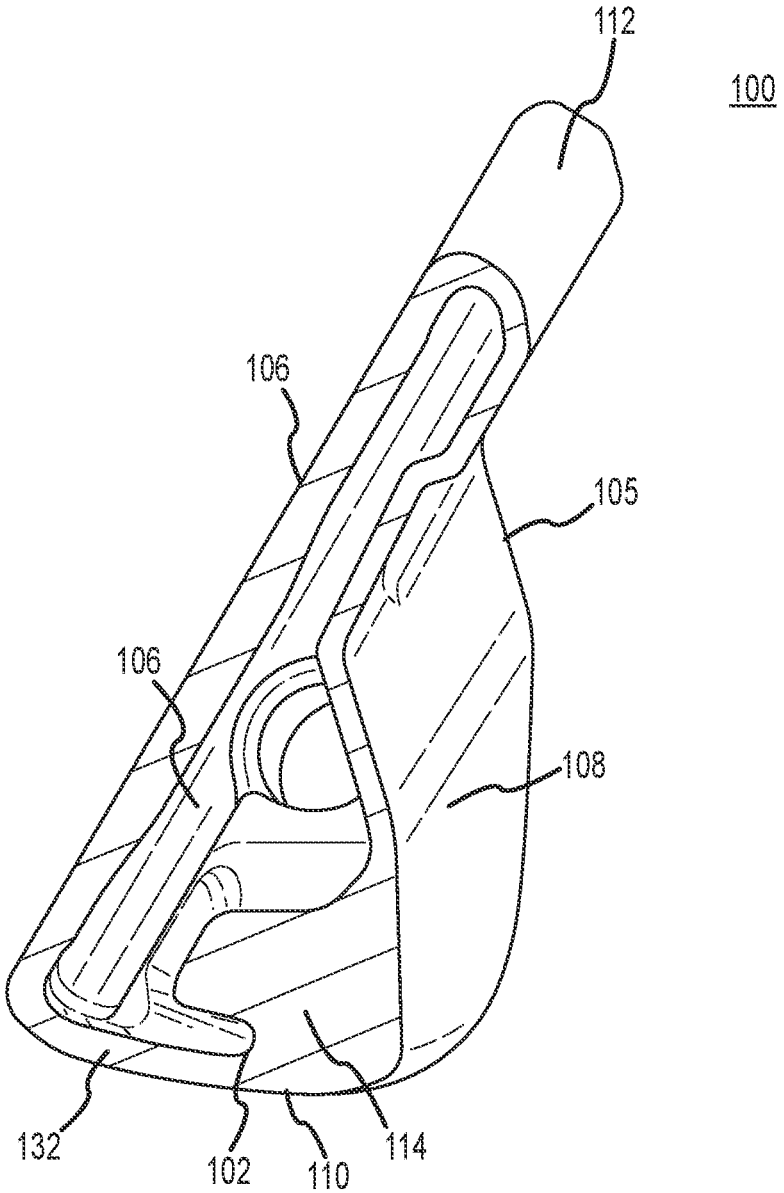
FIG. 2A depicts the hollow body club head of FIG. 1 along the cross-sectional line I-I.

FIG. 1 of the drawings depicts a perspective view of an iron-type golf club head 100 exterior having an internal stress relieving sole 110 and ballast 114 having an undercut 102, shown in FIG. 2A. The golf club head 100 comprises a hollow body structure with an internal cavity 104. The hollow body structure of golf club head 100 is further defined by a strikeface 106, a rear portion 108 opposite the strikeface 106, a heel portion 103, a toe portion 105 opposite the heel portion 103, a sole 110, and a top rail 112 opposite the sole 110.

FIG. 2A illustrates a heel cut away view of the FIG. 1 golf club head 100 along cross-sectional line I-I. FIG. 2A shows the internal cavity 104 and stress relieving features of golf club head 100. The rear portion 108 further comprises a ballast 114 located within the internal cavity 104. As shown in FIG. 2, the ballast 114 is an integral weighting element necessary for optimal CG (center of gravity) positioning in golf club head 100. The ballast 114 is a solid structure protruding vertically from the sole 110, forward from the rear portion 108, and extending along the sole 110 in a heel to toe direction. A forward portion of the sole 132 is defined between the strikeface 106 and the ballast 114.

Figure 2B:
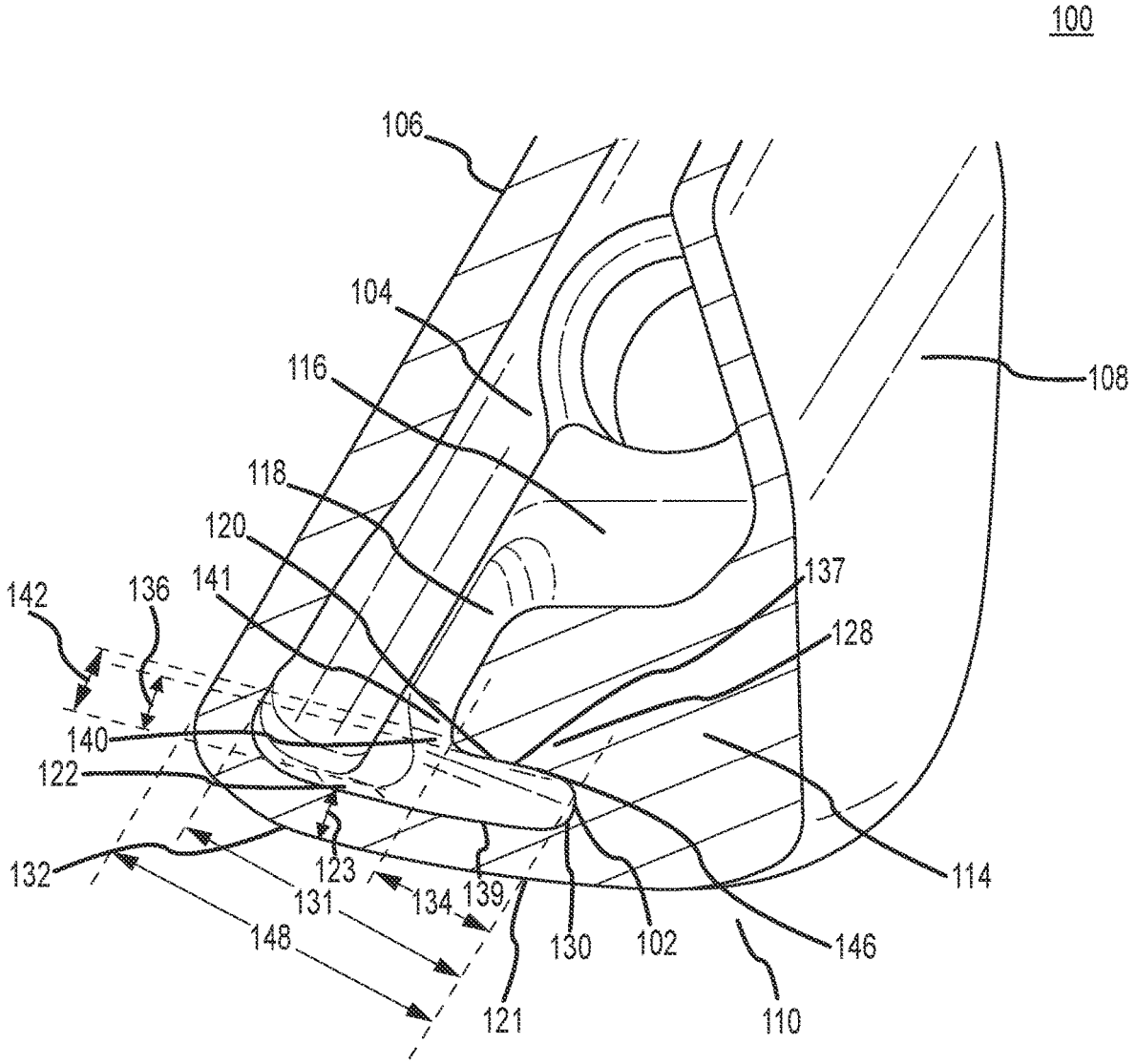
FIG. 2B depicts a view of a portion of the hollow body club head of FIG. 2A.

Continuing to refer to FIG. 2B, the ballast 114 comprises a top surface 116, a forward surface 118, and a bottom surface 120. As illustrated, the bottom surface 120 is contoured to create a relief defining an undercut region 128 with undercut 102. The undercut region 128 of the ballast 114 can be studied as an undercut region 128 of material that has been removed from the ballast 114 adjacent an interior surface 122 of the sole 110. The undercut region 128 comprises undercut 102 and an undercut transition 141. The undercut region 128 extends laterally in a heel to toe direction over a heel to toe length 124 of the ballast 114. In the illustrated embodiment, the undercut 102 is generally centered within the club head 100 between the heel portion 103 and toe portion of the golf club 100. As shown in FIG. 2B, the undercut 102 extends beneath the ballast 114, such that forward portion 132 of the sole 110 is bounded between the face and the undercut 102/bottom surface 120 of the ballast 114. The forward portion 132 of the sole 110 is effectively lengthened, as compared to golf club head without an undercut (i.e., a forward portion defined between the strikeface and the forward surface of the ballast). Therefore, the undercut 102 not only reduces stress in the forward portion 132 of the sole, but creates a larger spring (i.e., the forward portion of the sole) for transferring energy back to the ball at impact.

FIG. 2B depicts a zoomed-in view of the ballast 114 and undercut 102 shown the FIG. 2A cross section. As shown in FIG. 2B, the ballast 114 comprises top surface 116, forward surface 118, and bottom surface 120. The ballast 114 protrudes vertically from an interior surface of the sole 106 along an interior surface of the rear portion 108. The bottom surface 124 comprises a contoured geometry that extends inward, from the forward surface 118 toward the rear portion 108 to define the undercut 102, which extends in a heel to toe direction. Continuing to refer to the FIG. 2B cross section, the ballast bottom surface 120 further comprises an undercut juncture 130 defined as the juncture between the ballast bottom surface 120 and the interior surface 122 of the sole 110. The undercut juncture 130 is a rearmost point of the ballast bottom surface 120 that defines the undercut 102. As shown, the forward portion 132 of the sole is defined between the strikeface 106 and the undercut juncture 130, rather than the strikeface 106 and the forward surface 118 in a hollow body iron without undercut 102.

Referring to FIG. 2B, the undercut 102 is defined by four parameters: undercut depth 134, undercut height 136, undercut length 138, an undercut sole thickness 123. Further, the ballast bottom surface 120 can be curved such that the undercut 102 is defined between an undercut bottom edge 139 and an undercut top edge 137. The undercut depth is measured as a perpendicular distance between a ballast forward plane 20 and the undercut juncture 130 (i.e., the rear most point of the undercut). The undercut height 136 is defined as the vertical distance between an undercut top edge 137 and an undercut bottom edge 139. The undercut length is measured parallel to a ground plane 10 between the undercut toe end 133 and the undercut heel end 135. Finally, the undercut sole thickness 123 is measured as the perpendicular distance from the exterior surface of the sole 121 and an interior surface of the sole 121. In a first embodiment, the undercut 102 has a depth 134 of 0.065 inch, a height 136 of 0.083 inch, a length of 1.16 inches.

The undercut depth 134, between the ballast forward plane 20 and the undercut juncture 130, has a range of 0.010 inch to 0.100 inch. For example, the undercut depth 134 can be 0.010 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, or 0.100 inch. Alternatively, an undercut face depth 131 can be measured as the perpendicular distance between an interior surface of the strikeface 106 and the undercut juncture 130. In some embodiments, the undercut depth from the face ranges from 0.200 inch to 0.500 inch. For example, the undercut depth from the face can be 0.200 inch, 0.220 inch, 0.240 inch, 0.260 inch, 0.280 inch, 0.300 inch, 0.320 inch, 0.340 inch, 0.360 inch, 0.380 inch, 0.400 inch, 0.420 inch, 0.440 inch, 0.460 inch, 0.480 inch, or 0.500 inch.

The undercut height 136, measured between the undercut bottom edge 137 and undercut top edge 139, can range from 0.030 inch to 0.200 inch. For example, the undercut height 136 range from 0.030 inch to 0.040 inch, 0.040 inch to 0.050 inch, 0.050 inch to 0.060 inch, 0.060 inch to 0.070 inch, 0.070 inch to 0.080 inch, 0.080 inch to 0.090 inch, 0.090 inch to 0.100 inch, 0.100 inch to 0.110 inch, 0.110 to 0.120 inch, 0.120 inch to 0.130 inch, 0.130 inch to 0.140 inch, 0.140 inch to 0.150 inch, 0.150 inch to 0.160 inch, 0.160 inch to 0.170 inch, 0.170 inch to 0.180 inch, 0.180 inch to 0.190 inch, or 0.190 inch to 0.200 inch.

Figure 3:
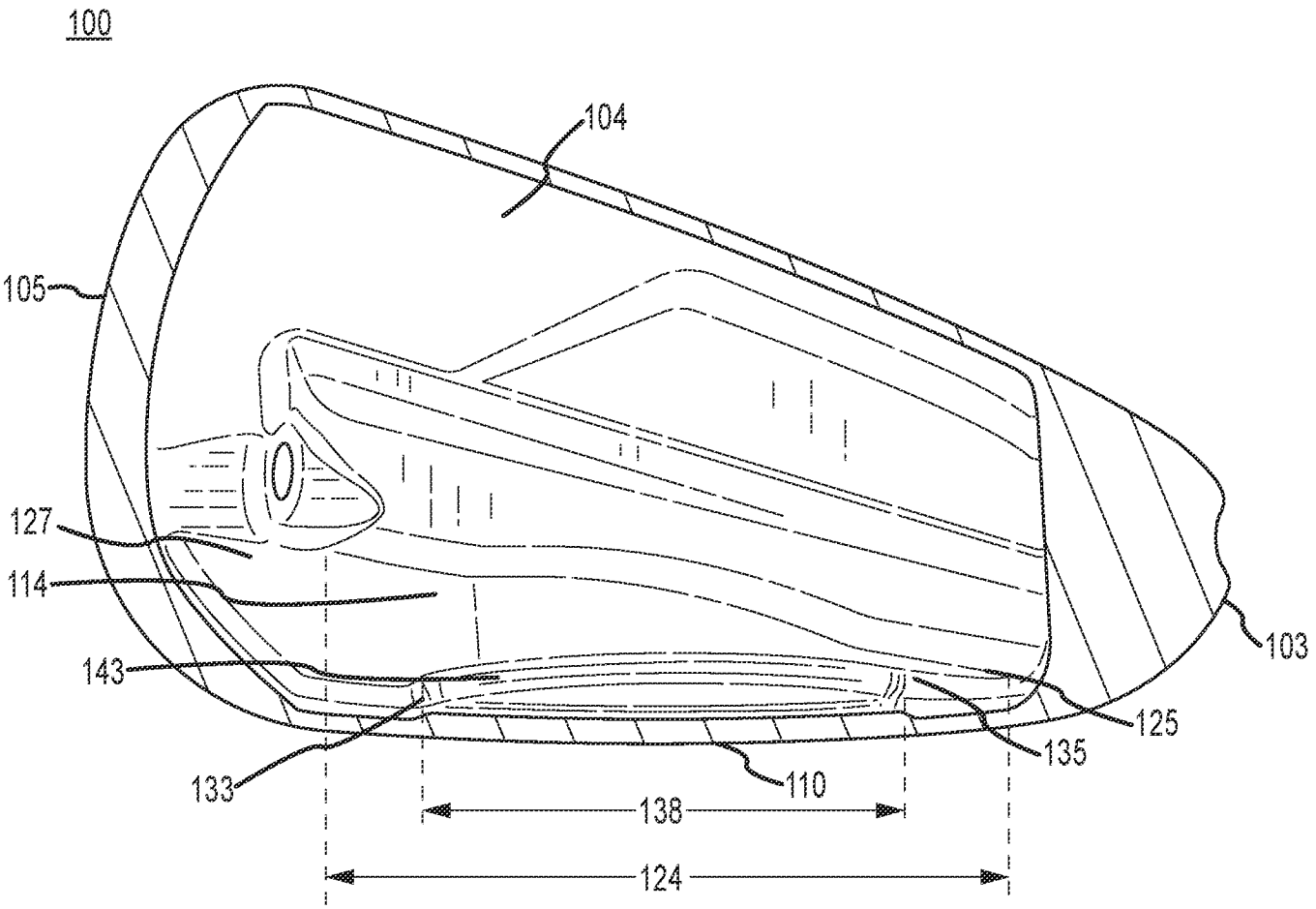
FIG. 3 depicts a front view of an internal cavity of FIG. 1.

FIG. 3 depicts a front view of golf club 100 wherein the strikeface 106 is removed to expose the undercut length 138 extending from the undercut heel end 135 to the undercut toe end 132. In some embodiments, the undercut length 138 ranges from 0.5 inch to 3.0 inches. In other embodiments, the undercut length ranges from 0.50 inch to 0.75 inch, 0.75 inch to 1.00 inch, 1.00 inch to 1.25 inches, 1.25 inches to 1.50 inches, 1.50 inches to 1.75 inches, 1.75 inches to 2.00 inches, 2.00 inches to 2.25 inches, 2.25 inches to 2.50 inches, 2.50 inches to 2.75 inches, or 2.75 inches to 3.00 inches. FIG. 3 further shows the ballast length 124, which can be measured from a ballast heel end 125 to a ballast toe end 127. In some embodiments the ballast length 124 ranges from 1.0 inch to 3.0 inches. In other embodiments the ballast length 124 is 1.2 inches, 1.4 inches, 1.6 inches, 1.8 inches, 2.0 inches, 2.2 inches, 2.4 inches, 2.6 inches, 2.8 inches, or 3.0 inches.

The undercut length 138, measured as the distance between the undercut heel and toe ends, may further define a percent of the ballast length 124, to describe the portion of the ballast 114 comprising the undercut 102. In embodiments of iron type golf club heads comprising an undercut 102, the undercut 102 can increase the surface area experiencing impact loading. The percent ballast length can be calculated as the undercut length 138 divided by the ballast length 124. In some embodiments, the undercut percent ballast length ranges from 20% to 100%. The length of the undercut can range from 10% the length of the ballast length up to the same length as the ballast length (i.e., 100%). For example, the percent ballast length is 20%, 25%, 30%, 40%, 45%, 50%, 55%, 60%, 65%, 70%, 75%, 80%, 85%, 90%, or 95%.

In addition, an undercut transition height 142, as shown in FIG. 2B, is defined as the perpendicular distance between an interior surface of the sole 122 and forward surface lower edge 140. In some embodiments, the transition height 142 can range from 0.150 inch to 0.300 inch. The transition height can range from 0.150 inch to 0.160 inch, 0.160 inch to 0.170 inch, 0.170 inch to 0.180 inch, 0.180 inch to 0.190 inch, or 0.190 inch to 0.200 inch, 0.200 inch to 0.210 inch, 0.210 to 0.220 inch, 0.220 inch to 0.230 inch, 0.230 inch to 0.240 inch, 0.240 inch to 0.250 inch, 0.250 inch to 0.260 inch, 0.260 inch to 0.270 inch, 0.270 inch to 0.280 inch, 0.280 inch to 0.290 inch, or 0.290 inch to 0.300 inch In the first embodiment discussed above, the transition height is 0.185 inch. The undercut transition 141 having transition height 142 and a contoured profile allows the undercut 102 to smoothly transition to the ballast forward surface 118. This smooth transition promotes an even flow of stress through the undercut 102 and the ballast 114.

As discussed above, the undercut 102 and undercut region 128 can be considered as a region of ballast material that has been removed, when compared to iron-type golf club heads lacking an undercut. An undercut volume 146 is defined by a surface 146 of the undercut region 128 and the ballast forward plane 20. For example, in one embodiment, the surface 146 of the undercut region and the ballast forward plane 20 define an undercut volume 146 of 0.018 cubic inches. In other embodiments, the undercut volume ranges from 0.018 cubic inches to 0.050 cubic inches. For example, the undercut volume 146 can be 0.018 cubic inches, 0.020 cubic inches, 0.022 cubic inches, 0.024 cubic inches, 0.026 cubic inches, 0.028 cubic inches, 0.030 cubic inches, 0.032 cubic inches, 0.034 cubic inches, 0.036 cubic inches, 0.038 cubic inches, 0.040 cubic inches, 0.042 cubic inches, 0.044 cubic inches, 0.046 cubic inches, 0.048 cubic inches, or 0.050 cubic inches. The undercut volume 146 can be used to calculate mass removed from the ballast 114 by the undercut region 128. Mass is calculated by multiplying the undercut volume 146 by the material density of the ballast 114. For example, an undercut volume ranging from 0.018 cubic inches to 0.030 cubic inches. The undercut volume can be 0.018 cubic inches, 0.020 cubic inches, 0.022 cubic inches, 0.024 cubic inches, 0.026 cubic inches, 0.028 cubic inches, or 0.030 cubic inches. The amount of material removed from the ballast to form the undercut with a material density ranging from 6.0 g/cm$^3$ to 7.75 g/cm$^3$ or a range of mass from 1.75 grams to 2.40 grams. The amount of material removed from the ballast to form the undercut with a material density of 6.0 g/cm$^3$, 6.5 g/cm$^3$, 7.0 g/cm$^3$, or 7.75 g/cm$^3$ or a mass of 1.75 grams, 2.0 grams, 2.20 grams, 2.32 grams or 2.40 grams from the ballast 114.

The forward portion 132 of the sole 110 extending from the strikeface 106 to the ballast 114 affects the impact response of golf club head 100 with a golf ball. As shown in FIG. 2, the undercut juncture 130 is spaced further rearward from the strikeface 106 than the ballast forward surface 118. The undercut juncture's additional distance from the strikeface 106, means that the thinner, forward portion 132 of the sole 110 has been effectively lengthened (relative to an overall front-to-rear sole width) such that part of the forward sole portion extends beneath the ballast 114 (as compared to traditional golf club heads, which lack the undercut 102). A forward sole length can be measured as the perpendicular distance between the undercut juncture 130 and face plane 130. In some embodiments, the effective increase in length ranges from 6% to 12%. For example, the undercut 102 can increase length of the forward sole portion 132 by 6% to 7%, 7% to 8%, 8% to 9%, 9% to 10%, and 11% to 12%. Increasing the length of the thinned out forward portion 132 of the sole 110 reduces peak stress values in golf club head 100. Rather than behaving as a rigid connection, the undercut 102 generates stress relief at the face-sole transition 126 by allowing the forward portion 132 of the sole 110, between the strikeface 106 and the ballast 114, to deflect to a greater extent under impact loads. The undercut's effective increase in forward sole 132 length increases the total surface area over which impact load is distributed for a stress reduction of 1000 psi to 2000 psi within the forward portion 132 of the sole. Undercut 102 dually reduces stress concentrations within forward sole portion 132 and increases the bending/spring effect of the forward sole portion 132. Additionally, undercut 102 reduces peak stress values within the strikeface 106 by 2000 psi to 3500 psi. For example, the undercut can reduce peak stress values in the strikeface between 2000 psi to 2100 psi, 2100 psi to 2200 psi, 2200 psi to 2300 psi, 2300 psi to 2400 psi, 2400 psi to 2500 psi, 2500 psi to 2600 psi, 2600 psi to 2700 psi, 2700 psi to 2800 psi, 2800 psi to 2900 psi, 2900 psi to 3000 psi, 3100 psi to 3200 psi, 3200 psi to 3300 psi, 3300 psi to 3400 psi, or 3400 psi to 3500 psi.

Alone, the above decrease in stress, within the sole 110 and strikeface 106, can translate to an improved wear life of golf club head 100. In other words, golf club head 100 comprising ballast 114 with undercut 102 can be hit more times and played longer than a traditional golf club head without an undercut. For example, a hollow body golf club comprising an undercut 102 can have a failure count increase of 50 hits, 100 hits, 150 hits, 200 hits, 250 hits, or 300 hits. Fatigue failure in a cyclically loaded golf club occurs over time in locations of peak stress where small cracks form in the material. Cracks, in turn, amplify stress. Therefore, golf club head 100, with reduced peak stresses, experiences the crack growth and eventual fatigue failure at a slower rate.

Alternatively, the stress reduction achieved by the above ballast 114 and undercut 102 can be leveraged to improve club performance and ball speed. In some embodiments, the ballast 114 with undercut 102 can be provided in conjunction with a thinned strikeface 106. The extent to which the strikeface of a golf club head without the undercut 102 has been constrained by peak stress levels at the face-to-sole transition. Said another way, it is not possible to improve the performance of traditional golf clubs with a thinner face because the added stress from the thinner face results in peak stresses that exceed the critical K value. Golf club head 100, as discussed above, comprises ballast 114 with undercut 102 for stress reduction. Therefore, in some embodiments, strikeface 106 can be thinned without raising peak stress values beyond the critical K value at the sole-to-face transition.

The thinness reductions can be applied throughout the face. For example, in the geometric center of the face of the undercut club, the thickness at this region of the face can range between 0.080 to 0.150 inches. The thickness of the face at the geometric center of said face can be 0.150 inches, 0.140 inches, 0.130 inches, 0.120 inches, 0.110 inches, 0.100 inches, 0.090 inches, or 0.080 inches. In the perimeter toe region of the face of the undercut iron club, the thickness of the face can range from 0.050 to 0.090 inches. The thickness of the face at the perimeter toe region can be 0.050 inches, 0.060 inches, 0.065 inches, 0.070 inches, 0.071 inches, 0.074 inches, 0.076 inches, 0.077 inches, 0.079 inches, 0.080 inches, 0.082 inches, 0.084 inches, 0.086 inches, 0.088 inches, or 0.090 inches. The thickness of the face at the heel perimeter end of the undercut iron club can range from 0.045 inches to 0.090 inches. The thickness of the face at the heel perimeter end can be 0.045 inches, 0.050 inches, 0.055 inches, 0.060 inches, 0.065 inches, 0.070 inches, 0.075 inches, 0.080 inches, 0.085 inches, or 0.090 inches.

In some examples, the ballast 114 with undercut 102 reduces face thickness by 0.003 inches. In other examples the undercut 102 can allow the strikeface 106 to be thinned by 0.004 inches, 0.005 inches, 0.006 inches, 0.007 inches, 0.007 inches, 0.008 inches, 0.009 inches, or 0.010 inches. In an already thin strikeface 106, this reduction equates to a thinning of roughly 6%, or an increase in ball speed of 0.5 mph to 0.7 mph. In some examples, the undercut 102 allows the strikeface to be 3 to 8% thinner than the strikeface of a golf club head without an undercut. For example, the strikeface 106 can b 3% thinner, 4% thinner, 5% thinner, 6% thinner, 7% thinner, or 8% thinner.

As discussed above, the undercut region 128 has a volume 146 representative of mass removed from ballast 114. Ballast 114 functions as a mass pad for controlling the center of gravity (CG) for golf club head 100, such that the undercut 102 can alter club head CG. The CG can be defined relative to a geometric center 126 of the strikeface 106. The geometric center 126 of the strikeface 118 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure"). A front-rear CG depth 144 can be defined as a horizontal distance between the geometric center 126 the CG. For example, the front-rear CG depth 144 can range from 0.080 to 0.110 inches. The front-rear CG depth can be 0.080 inches, 0.082 inches, 0.084 inches, 0.086 inches, 0.088 inches, 0.090 inches, 0.092 inches, 0.094 inches, 0.096 inches, 0.098 inches, 0.100 inches, 0.105 inches, or 0.110 inches.

A ratio of undercut face depth 146 to the front-rear CG position is constrained between 3.0 and 5.5. For example, the face depth ratio 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0. In this range, the undercut 102 improves peak stress within the forward sole portion 132 without removing material from the ballast to the extent that CG position is compromised.

Furthermore, because of the CG position, the undercut does not affect the overall MOI of the club. For the purpose of determining club head moments of inertia, a coordinate system may be defined at the CG via mutually orthogonal axes (i.e., an x-axis, a y-axis, and a z-axis) (Figure not shown). The y-axis extends through the head CG from the top rail 112 to the sole 110, perpendicular to a ground plane 10 when the club head is at an address position. The x-axis extends through the head CG from the heel 103 to the toe 105 and perpendicular to the y-axis. The z-axis extends through the head CG from the strikeface 106 to the rear portion 108, and perpendicular to the x-axis and the y-axis.

Moments of inertia then exist about the x-axis Ixx (i.e. top rail-to-sole moment of inertia), about the y-axis Iyy (i.e. heel-to-toe moment of inertia) and about the z-axis (i.e., strikeface to rear). In many embodiments, the golf club head with undercut comprises a top rail-to-sole moment of inertia, Ixx, can range from 95 $g \cdot in^2$ to 130 $g \cdot in^2$. In many embodiments, the golf club head with undercut comprises a top rail-to-sole moment of inertia Ixx greater than approximately 95 $g \cdot in^2$, greater than approximately 98 $g \cdot in^2$, greater than approximately 100 $g \cdot in^2$, greater than approximately 102 $g \cdot in^2$, greater than approximately 103 $g \cdot in^2$, greater than approximately 104 $g \cdot in^2$, greater than approximately 105 $g \cdot in^2$, greater than approximately 106 $g \cdot in^2$, greater than approximately 110 $g \cdot in^2$, greater than approximately 115 $g \cdot in^2$, greater than approximately 120 $g \cdot in^2$, greater than approximately 125 $g \cdot in^2$, greater than approximately 130 $g \cdot in^2$, greater than approximately 135 $g \cdot in^2$, greater than approximately 140 $g \cdot in^2$, greater than approximately 6750 $g \cdot in^2$, or greater than approximately 145 $g \cdot in^2$. Further, in many embodiments, the golf club head with undercut comprises a heel-to-toe moment of inertia Iyy, which may be greater than approximately 350 $g \cdot in^2$, greater than approximately 360 $g \cdot in^2$, greater than approximately 370 $g \cdot in^2$, greater than approximately 380 $g \cdot in^2$, greater than approximately 390 $g \cdot in^2$, greater than approximately 400 $g \cdot in^2$, greater than approximately 410 $g \cdot in^2$, greater than approximately 420 $g \cdot in^2$, or greater than approximately 430 $g \cdot in^2$. In many embodiments, the golf club head with undercut comprises a heel-to-toe moment of inertia Iyy can range from 350 $g \cdot in^2$ to 420 $g \cdot in^2$. Further, the club head with undercut comprises a strikeface to rear moment of inertia Izz, which may be greater than approximately 400 $g \cdot in^2$, greater than approximately 4100 $g \cdot in^2$, greater than approximately 420 $g \cdot in^2$, greater than approximately 430 $g \cdot in^2$, greater than approximately 440 $g \cdot in^2$, greater than approximately 450 $g \cdot in^2$, greater than approximately 460 $g \cdot in^2$, greater than approximately 470 $g \cdot in^2$, or greater than approximately 480 $g \cdot in^2$. In many embodiments, the golf club head with undercut comprises a strikeface to rear moment of inertia Izz can range from 400 $g \cdot in^2$ to 450 $g \cdot in^2$. The undercut of the golf club head does not significantly alter the moment of inertia of the Ixx, Iyy, and Izz axes over a golf club head without the undercut.

II. Undercut and Cascading Sole

Figure 4A:
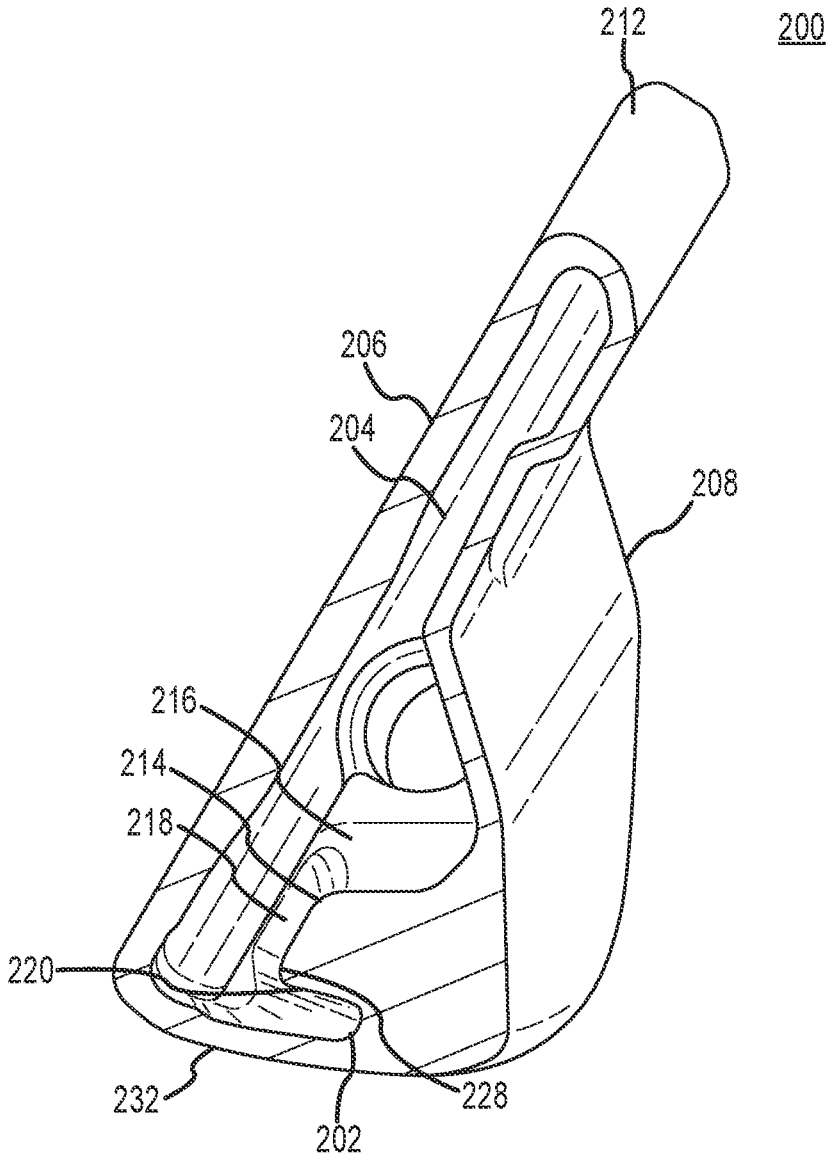
FIG. 4A depicts a cross-sectional view of a hollow body club, similar to the hollow body club of FIG. 1, along a cross-sectional line similar to cross-sectional line II-II of FIG. 1, according to another embodiment.

FIG. 4A illustrates another embodiment of a golf club head 200 comprising a ballast 214, undercut 202, and a cascading forward portion 232 of the sole 210. FIG. 4 depicts a cross-sectional view of golf club head 200. Golf club head 200 is substantially similar to golf club head 100 and comprises a thin forward portion 232 of sole 210 that has been effectively lengthened via the undercut 202. Golf club head 200 is further defined by a strikeface 206, a rear portion 208 opposite the strikeface 206, a heel portion 203, a toe portion 205 opposite the heel portion 203, a sole 210, and a top rail 212 opposite the sole 210. Together, these components define a hollow body club with an interior cavity 204. The rear portion 206 further comprises a ballast 214 located within the internal cavity 204. As shown in FIG. 4, the ballast 214 comprises the top surface 216, the forward surface 218, and the bottom surface 220. Ballast bottom surface 220 is similar to ballast bottom surface 120. The contoured bottom surface 220 is indented toward the rear portion 208 to create undercut 202.

Figure 4B:
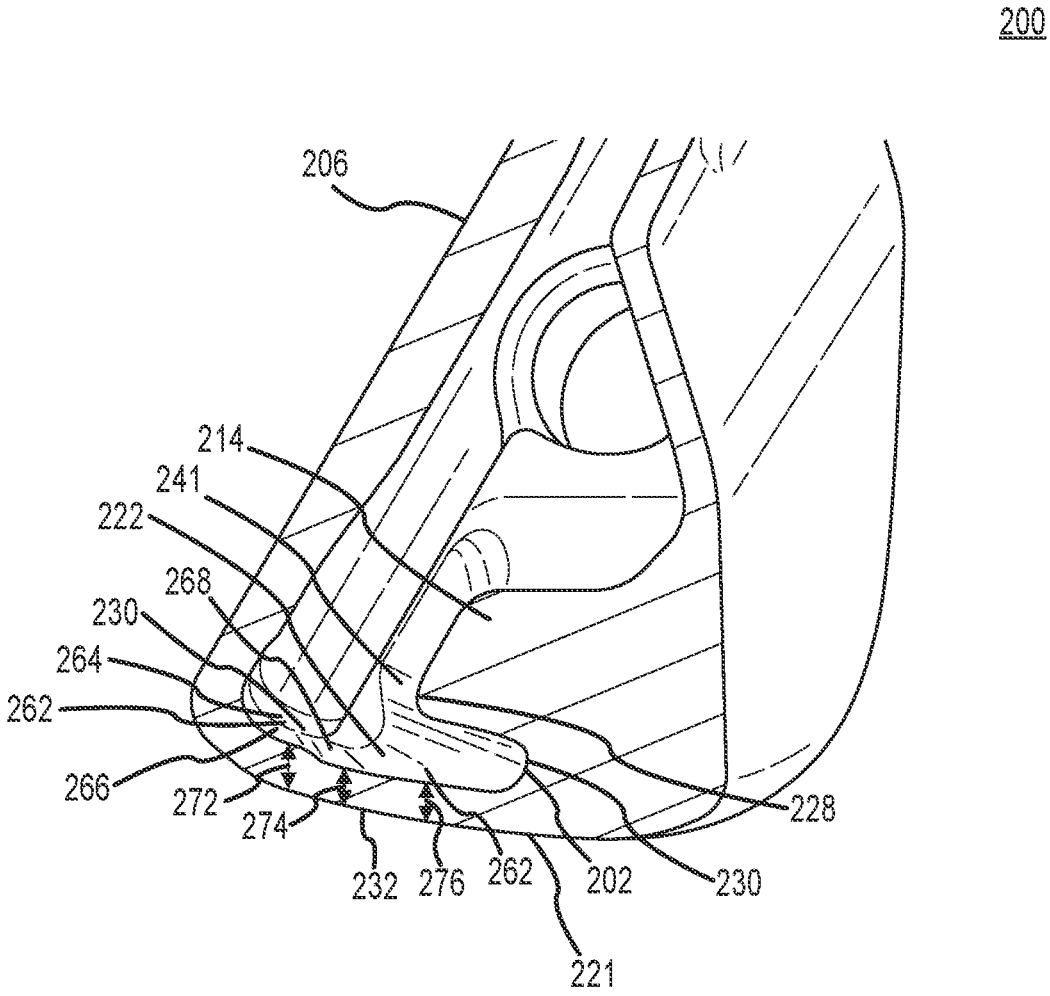
FIG. 4B depicts a view of a portion of the hollow body club of FIG. 4A.

FIG. 4B provides a zoomed in view of the ballast 214 and sole 210 illustrated in FIG. 4. As shown, the forward portion 232 of the sole 210 extends from the undercut 202 in ballast 214 to the strikeface 206. The forward portion 232 of the sole further comprises an inner region 260 and a cascading region 262. The cascading region 262 can comprise an internal radius transition 264 between an internal surface of the strikeface 206 and an internal surface of the sole 210. The cascading region 262 can comprise at least two thickness tiers, or levels. The tiered structure creates successive thinning of the forward sole portion 132. In some embodiments, the cascading region 262 can comprise an internal radius transition 264 having 2, 3, 4, 5, 6, or 7 tiers.

Continuing to refer to FIG. 4B, the cascading region 262 comprises a first tier 266, second tier 268, and a tier transition 270 between the first tier 266 and second tier 268. The cascading region 262 of the forward sole portion 232 can have a thickness measured as the perpendicular distance between the exterior surface 221 of the sole and interior surface 222 of the sole. This thickness can decrease in a front to rear direction over the cascading region 262. The first tier 266 can have a first thickness 272 defined as the perpendicular distance between the exterior surface 221 and interior surface 222 of the sole within the first tier 266. The second tier 268 can have a second thickness 274 defined within the second tier 268 as the perpendicular distance between the exterior surface 221 and interior surface 222 of the sole. In some embodiments, the first thickness 272 is greater than the second thickness 274, such that the overall thickness of the cascading region 262 decreases in the front to rear direction. The first thickness 272 and/or the second thickness 274 can have a constant thickness over a tier length in the front to rear direction. In other embodiments, the first thickness 272 and/or the second thickness 274 can be sloped to decrease in thickness over the tier length in the front to rear direction.

The cascading region can comprise a first tier 266, second tier 268, a third tier (not shown), and a first tier transition 270 between the first tier 266 and second tier 268, and a second tier transition between the second tier and the third tier. As described above, the cascading region of the forward sole region with three tiers can have a thickness measured as the perpendicular distance between the exterior surface of the sole and interior surface of the sole. Again, the thickness decreases in a front to rear direction over the cascading region. As described above, the first tier can have a first thickness. The second tier can have a second thickness. The third tier can have a third thickness, wherein the third tier thickness (like the first and second tier thicknesses) is measured as the perpendicular distance between the exterior surface and interior surface of the sole. In some embodiments, the first thickness is greater than the second thickness, and in turn, the second thickness is greater than the third thickness, such that the overall thickness of the cascading region 262 decreases in the front to rear direction. The first thickness and/or the second thickness and/or third thickness can have a constant thickness over a tier length in the front to rear direction. In other embodiments, the first thickness and/or the second thickness and/or third thickness can be sloped to decrease in thickness over the tier length in the front to rear direction.

The tier transition 270, between a rear edge of the first tier and a forward edge of the second tier, can be declined in a front to rear direction to steadily decrease the cascading region thickness between the first thickness 272 and second thickness 274. Alternatively, in a cascading region with two tier transitions (i.e., a first transition between the first tier and second tier, and a second transition between the second tier and third tier), the transitions can be declined in a front to rear direct to steadily decrease the cascading region thickness between the first thickness, second thickness and third thickness (or first tier, second tier and third tier). In some embodiments, such as FIG. 4B, the tier transition 270 is linearly declined at an angle less than 45 degrees between adjacent first 266 and second tiers 268. In some embodiments, the tier transition 270 is linearly declined at an angle ranging between 10 degrees and less than 45 degrees. The linear decline can be gradual between 5 degrees and 10 degrees, 10 degrees and 15 degrees, 15 degrees and 20 degrees, 20 degrees and 25 degrees, 25 degrees and 30 degrees, 30 degrees and 40 degrees, or 40 degrees and 45 degrees. In other embodiments, not shown, the tier transition 270 can be a steeper, and more like a step. For example, tier transition 270 can be between 45 and 50 degrees, 50 degrees and 55 degrees, 55 degrees and 60 degrees, 60 degrees and 65 degrees, or 65 degrees and 70 degrees.

As mentioned above, the forward sole portion 232 further comprises inner region 260 between the cascading region 262 and ballast undercut 202. The uniform inner region 260 also comprises an inner thickness 276 defined as the perpendicular distance between the exterior surface of the sole 221 and the inner surface of the sole 222. The inner thickness 276 is less than the thickness of an adjacent tier, or final tier within the cascading region 262. As shown in FIG. 4B, the inner thickness 276 is less than the second thickness 274.

Continuing to refer to FIG. 4B, the inner region 260 of forward sole portion 232 can be effectively lengthened by ballast 214 comprising undercut 202. Ballast 214 is substantially similar to the geometry of ballast 114. Ballast bottom surface defines an undercut region 228 comprising the undercut 202, undercut transition 241, and undercut juncture 230. As shown in FIG. 4B, the inner region 260 is positioned adjacent undercut 202. The undercut region 228 functions in a substantially similar manner as undercut 202 and undercut region 228. Specifically, undercut region 228 also reduces stress concentrations within forward sole portion 232 and increases the bending/spring effect of the forward sole portion 232.

In many embodiments, performance improvements from cascading sole 262 and undercut 202 are compounding. In other words, golf club heads having both a cascading region and undercut 202, such as hollow body club 202, have a greater reduction in peak stress than golf club heads comprising one of a cascading region or an undercut. Reduction of peak stress within forward sole portion 232 increases the region's tolerance to modifications for improving ball speeds. Specifically, hollow body club 200 comprising forward sole region 232, which is defined by undercut 202 and comprising cascading region, can comprise a thinner face (as compared to a hollow body club lacking either or both of the undercut and cascading sole). This results in better ball speeds and flight distance. In some embodiments, the undercut 202 and cascading sole 242 allow the forward portion of the sole 232 to be made more reactive. Rather than remaining rigid, the forward portion 232 can be thinned, such that the forward portion 232 behaves as a spring under impact loads. This means that the golf club head 200 is more efficient at transferring swing energy to the golf ball. The ultimate increase in ball speed via reduction in average thickness of the forward portion 232 of the sole is the result of stress reduction at the face-to-sole transition 226. The undercut and the cascading sole work together to improve the flow of stress within the forward portion 232, thereby reducing stress concentration levels at impact.

EXAMPLES

Example 1: Study of Undercut in Hollow Body Iron

As described in detail above, the ballast and undercut can be applied to a golf club head alone and in conjunction with other features, such as a cascading sole, to improve club performance. In the example below, performance improvements generated by the undercut 102 were studied by comparing a golf club head without an undercut (golf club A, hereafter "Club A"), a golf club head with an undercut (golf club B, hereafter "Club B"), a golf club head without an undercut and with a cascading sole (golf club C, hereafter "Club C"), and a golf club head with an undercut and with a cascading sole (golf club D, hereafter "Club D"). Performance improvements were measured and analyzed using finite element analysis (FEA). Specifically, FEA was used to measure peak stress values within the forward portion. Average peak stress, along with a measured surface area experiencing peak stress, were used to determine the potential for each club to efficiently transfer impact energy back to the ball. Reductions in average peak stress serve as an indicator for improved durability and potential performance enhancement via face thinning and sole thinning.

Each of the example Clubs A, B, C, and D were substantially similar having the same overall mass, material construction, and loft angle. Impact loading in each club was simulated at 105 mph. The example clubs each comprise unique internal cavity configurations, described above. Average peak stress between the strikeface and ballast, within the forward portion of the sole, was calculated for each example. Likewise, an area of average peak stress was calculated for each example. Finally, average peak stress within the strikeface was calculated for each example. Table 1 below, shows the peak face stress, peak stress of the forward sole portion, and the peak stress area within the forward portion of the sole, for each of the example clubs discussed below. Stress values were used to determine the undercut's effect on club performance through face and sole thinning. Example Club A was compared to Club B. Example Club C was compared to Club D. The control club head was similar to the example club heads, but devoid of any stress relieving features.

| | Peak Face Stress | Peak Forward Sole Stress |
|---|---|---|
| Club A | 218469 psi | 158169 psi |
| Example 1 | 217117 psi | 156858 psi |
| Example 2 | 213311 psi | 155419 psi |
| Example 3 | 209851 psi | 154689 psi |

Club A

Figure 5:
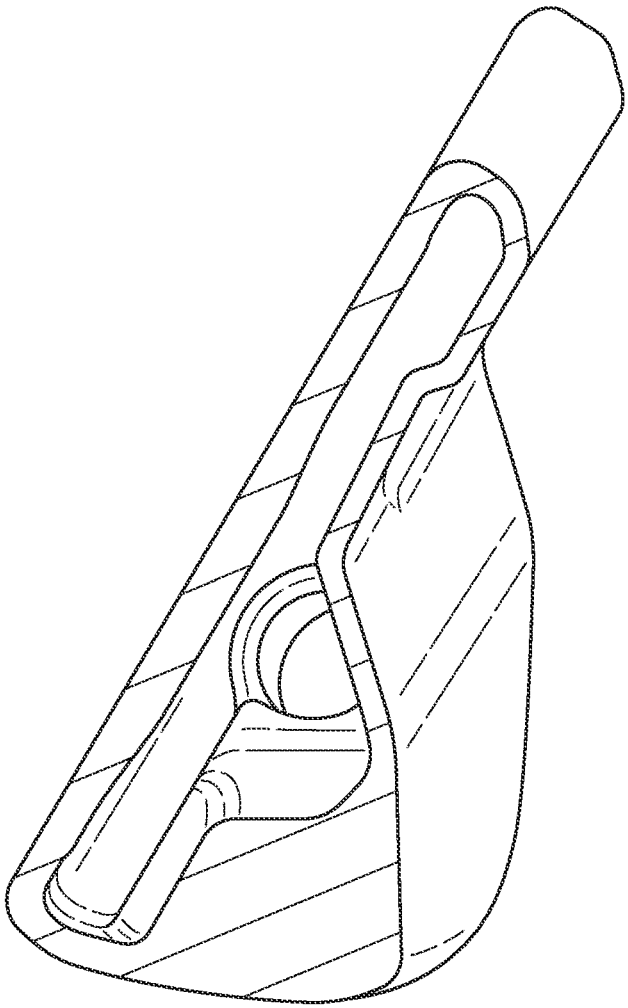
FIG. 5 depicts a cross-sectional view of a prior art hollow body club, along a cross-sectional line similar to cross-sectional line I-I of FIG. 1, according to another embodiment.

Club A was representative of a prior art golf club head lacking all stress relieving features and was similar to FIG. 5. As the representative of a traditional hollow body golf club head, Club A comprised a ballast without an undercut and without a cascading sole. Without an undercut, the forward portion of the sole and the ballast met at a substantially right angle. Likewise, without the cascading sole, the strikeface transitioned smoothly to the forward portion of the sole.

As shown in Table 1, FEA analysis was used to calculate a value for peak stress within the strikeface of the Club A. Under a 105 mph impact load, the peak stress of the strikeface was 218469 psi. Under the same impact load, the forward portion of the strikeface had a peak stress of 157440 psi.

Club B

Club B was representative of a hollow body golf club head with an undercut stress relieving feature. Hollow body Club B was similar to Club A, but Club B included an undercut as stress relieving feature. Rather than meeting at a right angle, the undercut allowed the forward portion of the sole to extend beneath the ballast. The undercut of Example 1 comprised a depth of 0.065 inch, a height of 0.083 inch, an undercut transition height of 0.185 inches, and 1.16 inches.

The values for peak face stress, peak forward sole stress, and peak stress area were determined with FEA analysis and simulated impact with a golf ball at 105 mph. The peak face stress was 217117 psi and the peak forward sole stress 156257 psi. When compared to the Club A, the undercut reduced peak stress within the strikeface by 1352 psi and reduced peak stress within the forward portion of the sole by 1183 psi. This club showed that the ballast and undercut allow the both the strikeface and forward portion of the sole to store more strain energy. This means that Club B showed improved durability and improved spring response to impact loading.

Club C

The hollow body Club C was representative of a club head comprising a forward portion of the sole with a cascade, only. Club C was similar to Club A and B, but comprised a cascading sole as a singular form of stress relief. The transition from face to sole comprised first tier, a second tier and a tier transition between the first tier and the second tier. The first tier had a first tier thickness and second tier thickness, less than the first tier thickness. The tier transition was sloped to gradually transition the first tier thickness to the second tier thickness. The example did not comprise an undercut and the forward portion of the sole and ballast met at a substantially right angle.

Referring again to Table 1, the Example 2 hollow body golf club head had a peak face stress of 213311 psi, or a 5158 psi reduction of peak stress within the strikeface. The Example 2 club had a peak forward sole stress of 154742 psi (pounds per square inch), or a reduction in peak forward sole stress of 2698 psi This example showed that cascading sole reduced stress through increased storage of strain energy for improved durability and spring response under impact loading.

Club D

Figure 6:
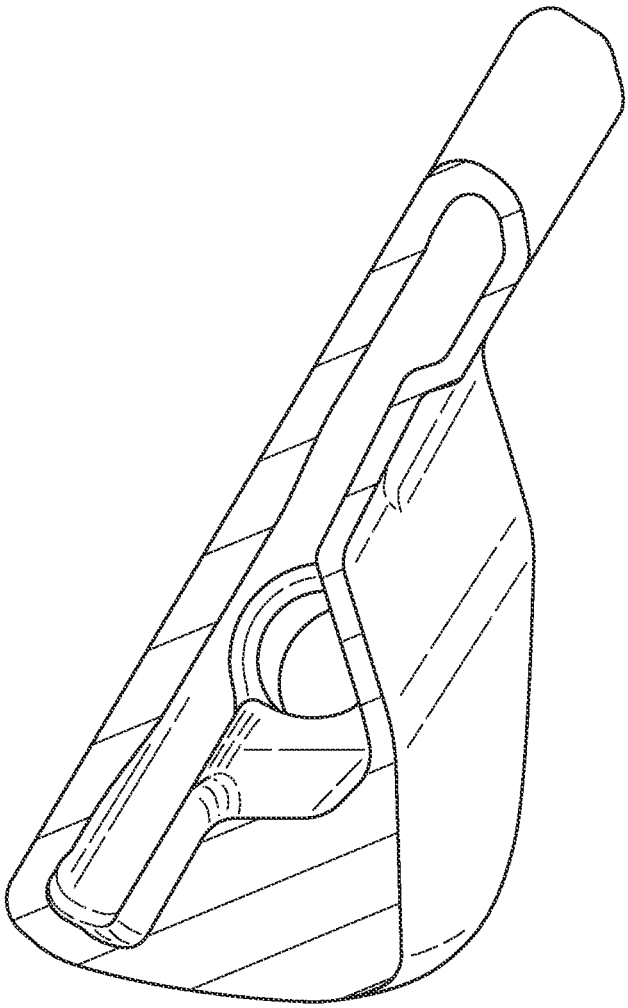
FIG. 6 depicts a cross-sectional view of a hollow body club, similar to the hollow body club of FIG. 1, along a cross sectional line similar to cross-sectional line I-I of FIG. 1, according to another embodiment.

Club D (shown as FIG. 6) comprising an undercut and a cascading sole as two forms of stress relief for the strikeface and forward sole portion. The ballast comprised an undercut, which effectively lengthened the forward sole portion beneath the ballast. The cascading sole comprised a first tier, a second tier, and a tier transition between the first and second tiers. The first tier comprised a first tier thickness and the second tier comprised a second tier thickness, less than the first tier thickness. The tier transition was sloped to gradually transition the first tier thickness to the second tier thickness.

Club D was also subjected to FEA analysis under simulated ball impact at 105 mph. The peak face stress was 209851 psi, for a reduction of peak stress in the strikeface of 8618 psi. In other words, the Club D had a 4% reduction in peak stress within the strikeface. The peak stress of the forward sole portion was 154689 psi. The forward sole portion had a peak stress reduction of 3480 psi, or a 2.2% reduction from the Club A. This example showed that the undercut and cascading sole worked together to reduce peak stresses. Further, this example indicated that the forward portion of the sole could tolerate additional loading without reaching fatigue failure. The example showed that ball speed could be improved by thinning the face and sole to match the loading capacity of the forward sole portion.

The peak stresses of the forward sole portion in each of the club heads, specifically, indicated the potential for adjusting sole and face thickness and the resulting changes to ball speed. The peak stress of the forward sole portion was compared to the critical K yield stress value of the forward sole portion. Stresses that indicated that the strikeface and sole must be thickened, signaled that the internal cavity configuration would have reduced ball speed. Stresses that indicated that the strikeface and sole could be thinned, signaled that the internal cavity configuration would have increased ball speed.

Club A and Club B were compared to each other relative to a critical K value of 156 ksi. The peak stress of Club A, without an undercut, was 158169 psi. This peak stress value suggested that the sole and face would have needed to be thickened by roughly 2.5% in order to achieve stress values that did not exceed 156 ksi. The thickened face and sole indicated that the internal cavity configuration that would degrade ball speed. Club B, which comprised an undercut, improved peak stress within the forward sole portion. Club B had a peak stress of 156868 psi. The lower peak stress of Club B indicated Club B required the sole and face to be thickened less than the sole and face of Club A. These results showed that, after modifications, Club B and the undercut indicated better ball speed over Club A, without an undercut.

Similarly, Club C and Club D were compared to each other relative to the same critical K value of 156 ksi. The peak stress of Club C, with a cascading sole and without an undercut, was 155416 psi. Club C, with peak stress slightly less than the critical K stress, indicated that no modifications for improving or degrading ball speed would have been necessary. The slightly lower peak stress did indicate that the cascading sole in Club C would have increased durability.

Club D comprised an undercut in addition to the cascading sole and had a peak stress of 154689 psi. Club D showed that the undercut provided further reduction to peak stress. This reduction in stress indicated that Club D had a face and sole that could tolerate thinning in order to improve ball speed.

The comparison of Club A and Club B and the comparison of Club C and Club D showed that the undercut reduced peak stress within the forward portion of the sole. These results further showed that the undercut could be applied to hollow body golf club heads to improve ball speed by leveraging stress reduction to thin the face and sole.

Example 2: Club Performance with Undercut

In a second example, player testing of physical clubs was used to study the performance benefits of the undercut. In this example, a 7 iron comprising an undercut was compared to a structurally similar 7 iron, which lacked an undercut. The sole and face of the 7 iron having the undercut were optimized and reduced in thickness. Over 700 shots were taken on each golf club to analyze ball speed, launch angle, and spin rate.

Figure 7:
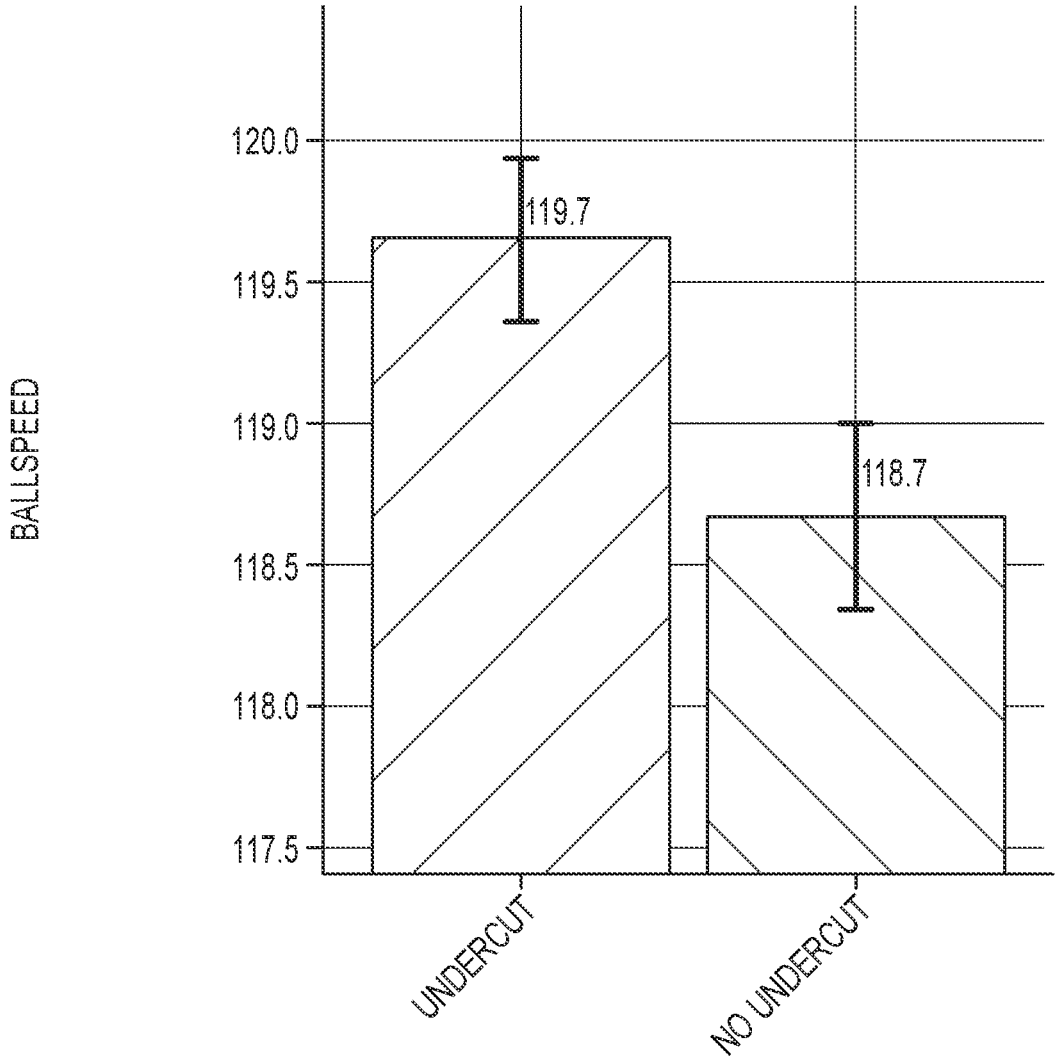
FIG. 7 depicts comparative a graph of ball velocity of a 7 iron measured in mph for various undercut embodiments described in this disclosure.
Figure 8:
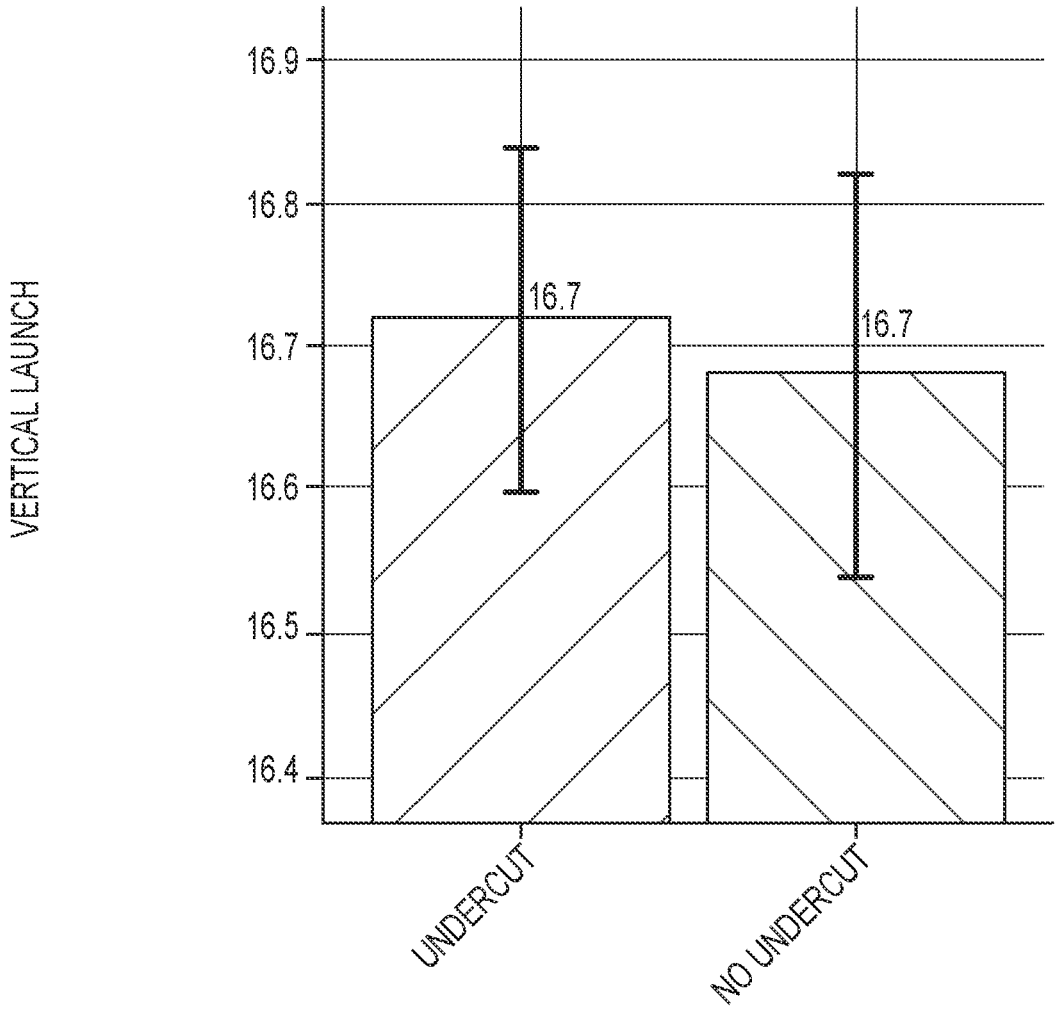
FIG. 8 depicts a comparative graph of vertical launch angle of the 7 iron of FIG. 7 in degrees for various undercut embodiments described in this disclosure.
Figure 9:
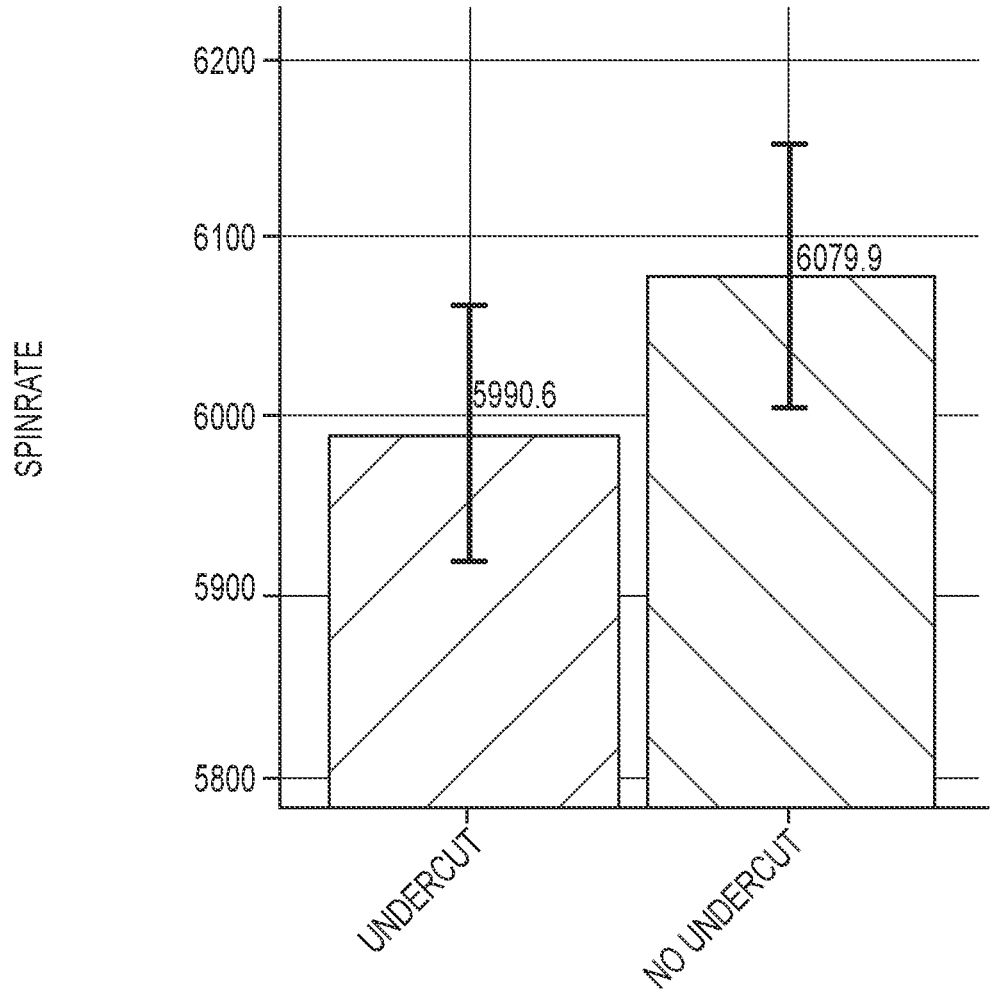
FIG. 9 depicts a comparative graph of spin rate of the 7 iron of FIG. 7 in rpm for various undercut embodiments described in this disclosure.

FIG. 7 compared the average ball speed of the 7 iron having an undercut and the 7 iron without an undercut. The average ball speed of the iron with the undercut was 119.7 mph. The average ball speed of the iron without the undercut was 118.7 mph. FIG. 8 compared the average vertical launch angle of the 7 iron with an undercut and the 7 iron without the undercut. The data showed that the 7 iron with the undercut and the 7 iron without the undercut had substantially similar launch angles. FIG. 9 compared the average spin rate of the same 7 iron with an undercut and 7 iron without an undercut. The 7 iron without an undercut had an average spin rate of 6079.9 rpm. The 7 iron without an undercut had a reduction in average spin with 5990.6 rpm.

Finally, the stat area (data not shown) of the 7 iron with the undercut was compared to the 7 iron without the undercut. The stat area data was used to determine the consistency of each of the golf club heads by plotting shot distance according to the left-right deviation from a straight shot. The 7 iron without the undercut had a distance deviation of 20 m, while the 7 iron with the undercut had a distance deviation of 14 m. The data showed that the undercut 7 iron produced shots that with more consistent distance.

The player results of Example 2 highlighted the performance benefits of the undercut. Specifically, the data showed that the undercut reduced spin on low lofted golf club heads, such as a 7 iron, and improved ball speed for improved distance. Reduced spin on low lofted golf clubs was preferred due to the distance requirements and expectations of longer, low lofted golf clubs. The Example also highlighted a tighter stat area for irons with an undercut and showed that the undercut irons performed more consistently for distance.

Example 3: Wet and Dry Conditions Performance with Undercut

In a third example, player testing of physical clubs was used to study the performance benefits of the undercut in varying turf conditions. In this example, a pitching wedge comprising an undercut was compared to a structurally similar pitching, which lacked an undercut. Each golf club was hit in wet conditions and dry conditions and values for average launch angle, spin rate, and ball speed were measured.

Figure 10:
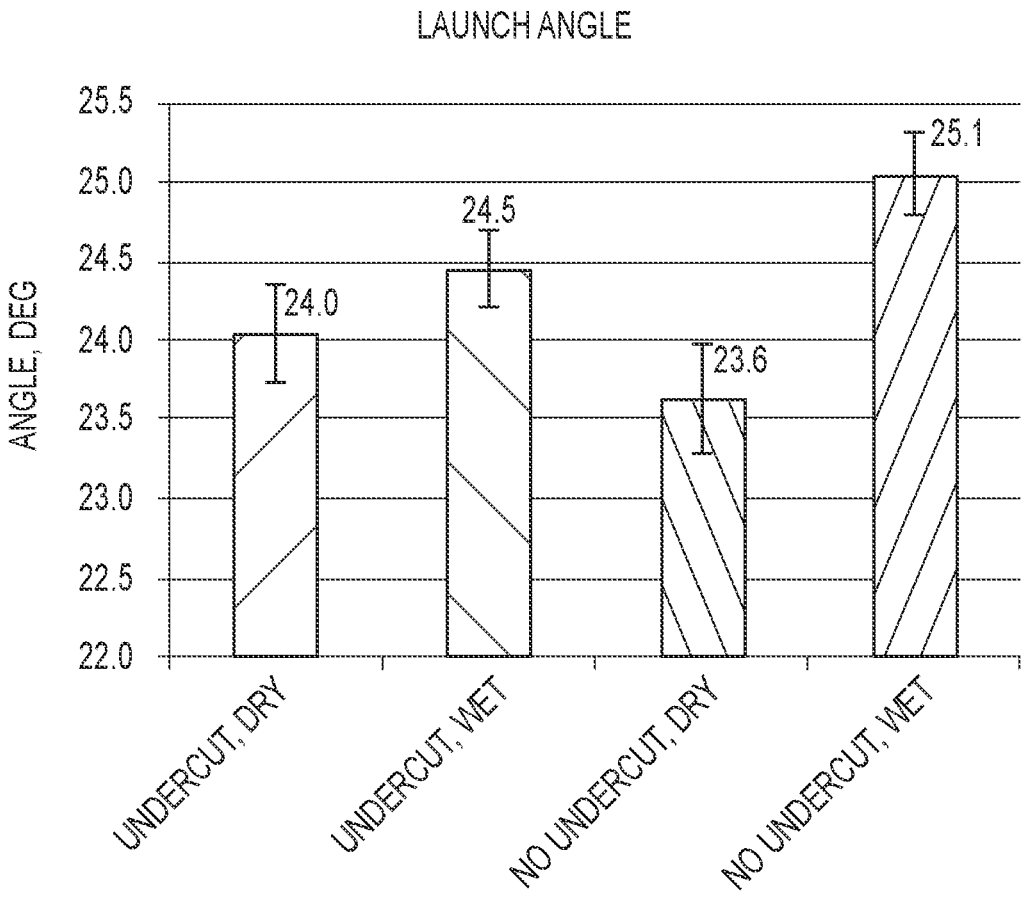
FIG. 10 depicts a comparative graph of vertical launch angle of a pitching wedge in degrees for various undercut embodiments described in this disclosure.

FIG. 10 compared the launch angle of a wedge with an undercut and a wedge without an undercut in both wet conditions and dry conditions. The wedge with an undercut had an average launch angle of 24.0 degrees in dry conditions and an average launch angle of 24.5 degrees in wet conditions. The wedge without an undercut had an average launch angle of 23.6 degrees in dry conditions and an average launch angle of 25.1 degrees in wet conditions. Therefore, launch angle in wedges with an undercut and without an undercut was comparable under wet conditions.

Figure 11:
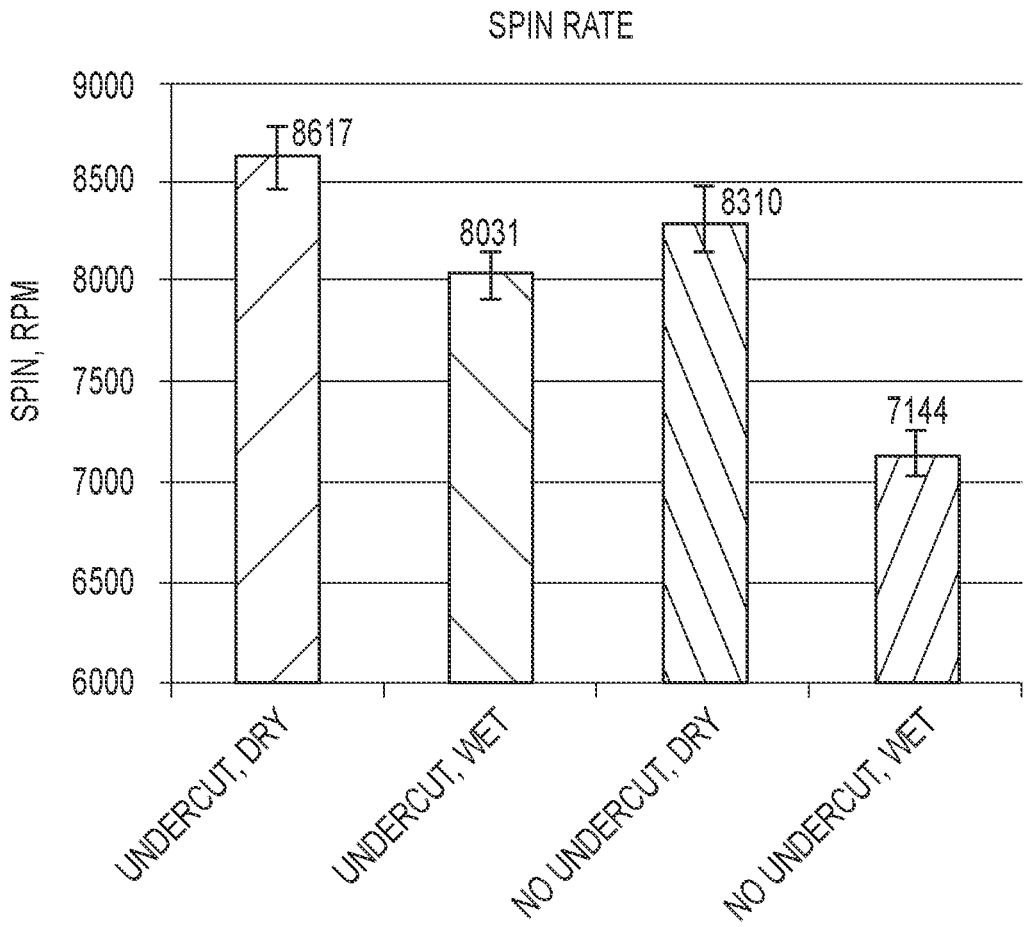
FIG. 11 depicts a comparative graph of spin rate of the pitching wedge of FIG. 10 for various undercut embodiments described in this disclosure.

FIG. 11 compared the spin rate of the same wedge with an undercut and wedge without an undercut in both wet and dry conditions. The wedge with an undercut had an average spin rate of 8617 rpm (revolutions per minute) in dry conditions and an average spin rate of 8031 rpm in wet conditions. The wedge without an undercut had an average spin rate of 8310 rpm and a spin rate of 7144 rpm in wet conditions. Therefore, the wedge with the undercut had increased spin rates to indicate better turf interaction in both wet and dry conditions for the undercut wedge.

Figure 12:
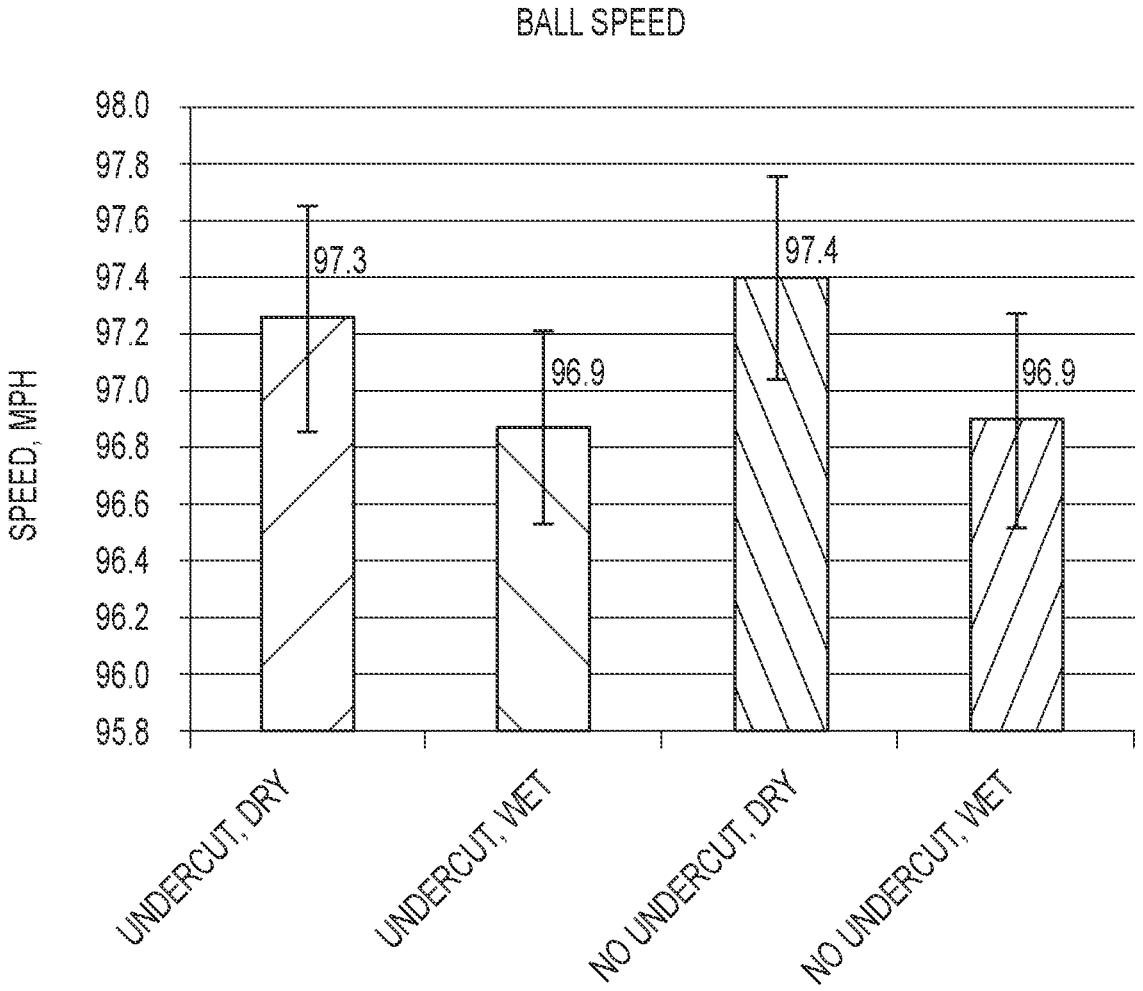
FIG. 12 depicts comparative a graph of ball speed of the pitching wedge of FIG. 11, measured in mph, for various undercut embodiments described in this disclosure.

FIG. 12 compared the ball speed of the wedge with the undercut and the wedge without the undercut. The wedge with the undercut had an average ball speed of 97.3 mph (mile per hour) in dry conditions and an average ball speed of 96.9 mph in wet conditions. The wedge without the undercut had an average ball speed of 97.4 mph in dry conditions and an average ball speed of 96.9 mph in wet conditions. The ball speed for the wedge with the undercut and wedge without the undercut were comparable in both wet and dry conditions.

The data above showed that the pitching wedge with the undercut performed more consistently in variable turf conditions than the wedge without an undercut. The launch angle of the wedge with the undercut varied by 0.5 degrees between wet and dry conditions, while the wedge without the undercut had a launch angle that 1.5 degrees. The data showed that the launch angle of the wedge without the undercut varied three times as much as the wedge with the undercut. Similarly, the spin rate of the ball coming off the wedge with the undercut was more consistent than the spin rate of the wedge without the undercut. The spin rate varied by just 586 rpm between dry and wet conditions for the wedge with the undercut, while the spin rate varied by 1166 rpm between dry and wet conditions for the wedge without the undercut. Consistent spin rates for wet and dry conditions of the undercut wedge were preferred, as the purpose of wedge-type golf clubs is consistent ball delivery on the green regardless of weather conditions. The ball speed of the wedge with and without the undercut were substantially similar.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A golf club head comprising:

a hollow body defining an enclosed internal cavity, the body comprising:

a strikeface;

a heel portion;

a toe portion opposite the heel portion;

a sole, wherein the sole comprises a forward sole portion and a rear sole portion;

a solid ballast extending substantially from the heel portion to the toe portion, wherein the solid ballast comprises a ballast top surface, a ballast forward surface, and a ballast bottom surface;

a top rail; and a rear portion extending between the top rail and the sole and on an opposite side of the internal cavity from the strikeface;

wherein the ballast bottom surface is contoured toward the rear portion to define an undercut;

wherein the undercut comprises:

a bottom edge;

a top edge;

an undercut juncture;

a heel end;

a toe end;

a face depth measured as a perpendicular distance between a face plane and the undercut juncture of 0.300 inch;

an undercut height measured as a distance between the bottom edge of the undercut and the top edge of the undercut between 0.080 inch to 0.090 inch; and an undercut volume of 0.018 cubic inches; and wherein the undercut is configured to alleviate stress in the forward sole portion between 1000 psi to 2000 psi.

2. The golf club head of claim 1, wherein the undercut further comprises an undercut length measured as the distance between the heel end and the toe end and said undercut length is between 1.00 inch to 1.25 inch.

3. The golf club head of claim 1, wherein the sole comprises a forward portion and a rear portion and wherein the undercut comprises a depth of 0.065 inch to extend a length of the forward portion between 7% and 8%.

4. The golf club head of claim 1, further comprising a cascading sole, wherein the cascading sole comprises an internal transition region from the strikeface to the sole; and the internal transition region comprises: a first tier comprising a first thickness; a second tier comprising a second thickness different than the first thickness; and a tier transition region between the first tier and the second tier.

5. The golf club head of claim 4, wherein the internal transition region further comprises a third tier.

6. The golf club head of claim 5, wherein the tier transitions are linearly declined at an angle less than 45 degrees.

7. The golf club head of claim 5, wherein the tier transitions are linearly declined at an angle ranging between 10 degrees and less than 45 degrees.

8. The golf club head of claim 1, wherein an undercut depth between a ballast forward plane and the undercut juncture ranges from 0.010 inches to 0.100 inches.

9. The golf club head of claim 1, wherein the hollow body further comprises a CG depth of 0.096 inches, a top rail-to-sole moment of inertia ranging from 95 $g \cdot in^2$ to 130 $g \cdot in^2$, and a heel-to-toe moment of inertia ranging from 350 $g \cdot in^2$ to 420 $g \cdot in^2$.

10. The golf club head of claim 9, further comprising a ratio of undercut face depth to CG depth, wherein said ratio is between 3.0 and 3.5.

11. A golf club head comprising:

a hollow body defining an enclosed internal cavity, the body comprising:

a strikeface;

a heel portion;

a toe portion opposite the heel portion;

a sole;

a solid ballast extending substantially from the heel portion to the toe portion, wherein the solid ballast comprises a ballast top surface, a ballast forward surface, and a ballast bottom surface;

a top rail; and a rear portion extending between the top rail and the sole and on an opposite side of the internal cavity from the strikeface;

wherein the sole comprises a front portion and a rear portion;

wherein the ballast bottom surface is curved toward the rear portion to define an undercut;

wherein the undercut comprises:

a bottom edge;

a top edge;

an undercut juncture;

a heel end;

a toe end;

a face depth measured as a perpendicular distance between a face plane and the undercut juncture of 0.300 inch;

an undercut height measured as a distance between the bottom edge of the undercut and the top edge of the undercut between 0.080 inch to 0.090 inch;

an undercut volume;

wherein the solid ballast further comprises a contoured undercut transition between ballast forward surface and the ballast bottom surface; and wherein the front portion of the sole comprises a length defined between a rear surface of the strikeface and the undercut juncture such that part of the front portion extends beneath the solid ballast.

12. The golf club head of claim 11, wherein the undercut comprises an undercut depth defined between a ballast forward plane and the undercut juncture; and wherein the undercut depth ranges from 0.065 inch to 0.100 inch to increase the the length of the front portion of the sole between 6% and 12% relative to an overall front-to-rear sole width.

13. The golf club head of claim 11, wherein the undercut comprises a volume defined by an undercut surface and a ballast forward plane, and wherein said volume ranges between 0.018 cubic inches to 0.050 cubic inches.

14. The golf club head of claim 11, wherein forward portion of the sole further comprises a cascade, the cascade comprises an internal transition region from the strikeface to the sole; and the internal transition region comprises: a first tier comprising a first thickness; a second tier comprising a second thickness different than the first thickness; and a tier transition region between the first tier and the second tier.

15. The golf club head of claim 14, wherein the internal transition region further comprises a third tier.

16. A golf club head comprising:

a hollow body defining an enclosed internal cavity, the hollow body comprising:

a strikeface;

a heel portion;

a toe portion opposite the heel portion;

a sole;

a solid ballast extending substantially from the heel portion to the toe portion, wherein the solid ballast comprises a ballast top surface, a ballast forward surface, and a ballast bottom surface;

a top rail; and a rear portion extending between the top rail and the sole and on an opposite side of the internal cavity from the strikeface;

wherein the sole comprises a spring portion configured to store strain energy and a rear portion;

wherein the ballast bottom surface is contoured toward the rear portion to define an undercut;

wherein the undercut comprises:

a bottom edge;

a top edge;

an undercut juncture;

a heel end;

a toe end;

an undercut height measured as a distance between the bottom edge of the undercut and the top edge of the undercut between 0.080 inch to 0.090 inch;

an undercut face depth measured as a perpendicular distance between an interior surface of the strikeface to the undercut juncture, said face depth ranging from 0.200 inches to 0.500 inches;

an undercut length between the heel end and the toe end;

wherein the spring portion of the sole extends between the strikeface to the undercut juncture to define a spring portion length and comprises a thickness between an exterior surface of the sole and an interior surface of the sole;

wherein the spring portion is thinner than the rear portion of the sole; and wherein the undercut and spring portion are configured to alleviate stress in the strikeface between 2000 psi to 3500 psi.

17. The golf club head of claim 16, wherein the strikeface comprises center region, a perimeter toe region, and a heel perimeter region;

wherein:

the center region comprises a first thickness between 0.080 inch and 0.150 inch;

the perimeter toe region comprises a second thickness between 0.050 inch and 0.090 inch; and the perimeter heel region comprises a third thickness between 0.045 inch and 0.090 inch.

18. The golf club head of claim 17, wherein the spring portion further comprises a cascading region, wherein the cascading region comprises an internal transition region from the strikeface to the sole; and the internal transition region comprises: a first tier comprising a first thickness; a second tier comprising a second thickness different than the first thickness;

and third tier comprising a third thickness different from the first and second thicknesses.

19. The golf club head of claim 18, wherein the second thickness is less than the first thickness and greater than the third thickness such that an overall thickness of the cascading region decreases in a front-to-rear direction.

20. The golf club head of claim 16, wherein the undercut further comprises an undercut depth of 0.065 inches, measured as a perpendicular distance from the ballast forward surface and the undercut juncture; and wherein the undercut depth is configured to increase the spring portion length relative to an overall front-to-rear sole length by 6% to 12%.

* * * * *